US005943800A

United States Patent [19]

Rose

[11] Patent Number: 5,943,800

[45] Date of Patent: Aug. 31, 1999

[54] FLOATING POP-UP DISPLAY STRUCTURES

[75] Inventor: Alan C. Rose, Tarzana, Calif.

[73] Assignee: Avery Dennison Corporation, Pasadena, Calif.

[21] Appl. No.: 08/948,926

[22] Filed: Oct. 10, 1997

[51] Int. Cl.[6] ..... G09F 1/00

[52] U.S. Cl. ..... 40/124.08; 446/148

[58] Field of Search ..... 40/124.01, 124.08, 40/124.09, 124.11, 124.191, 539, 661; 446/148

[56] References Cited

U.S. PATENT DOCUMENTS

| | | | |
|---|---|---|---|
| 4,146,983 | 4/1979 | Penick et al. | 40/124.08 |
| 4,349,973 | 9/1982 | Penick et al. | 40/124.08 |
| 4,879,824 | 11/1989 | Galloway | 40/661 X |
| 5,241,768 | 9/1993 | Thompson | 40/661 |
| 5,346,455 | 9/1994 | Volkert | 493/335 |
| 5,588,233 | 12/1996 | Volkert et al. | 40/124.08 |
| 5,687,495 | 11/1997 | Volkert | 40/124.08 |
| 5,758,438 | 6/1998 | Crowell | 40/124.08 |

*Primary Examiner*—Joanne Silbermann
*Attorney, Agent, or Firm*—Oppenheimer Wolff & Donnelly LLP

[57] ABSTRACT

A pop-up structure or sticker for use with two hinged panels, includes a display area, and is provided with transparent supporting legs or other structure, secured to both of the two hinged panels so that the pop-up structure or sticker folds flat when the panels are closed and pops up and appears to "float" over the hinged panels when they are opened.

24 Claims, 4 Drawing Sheets

FIG. 1
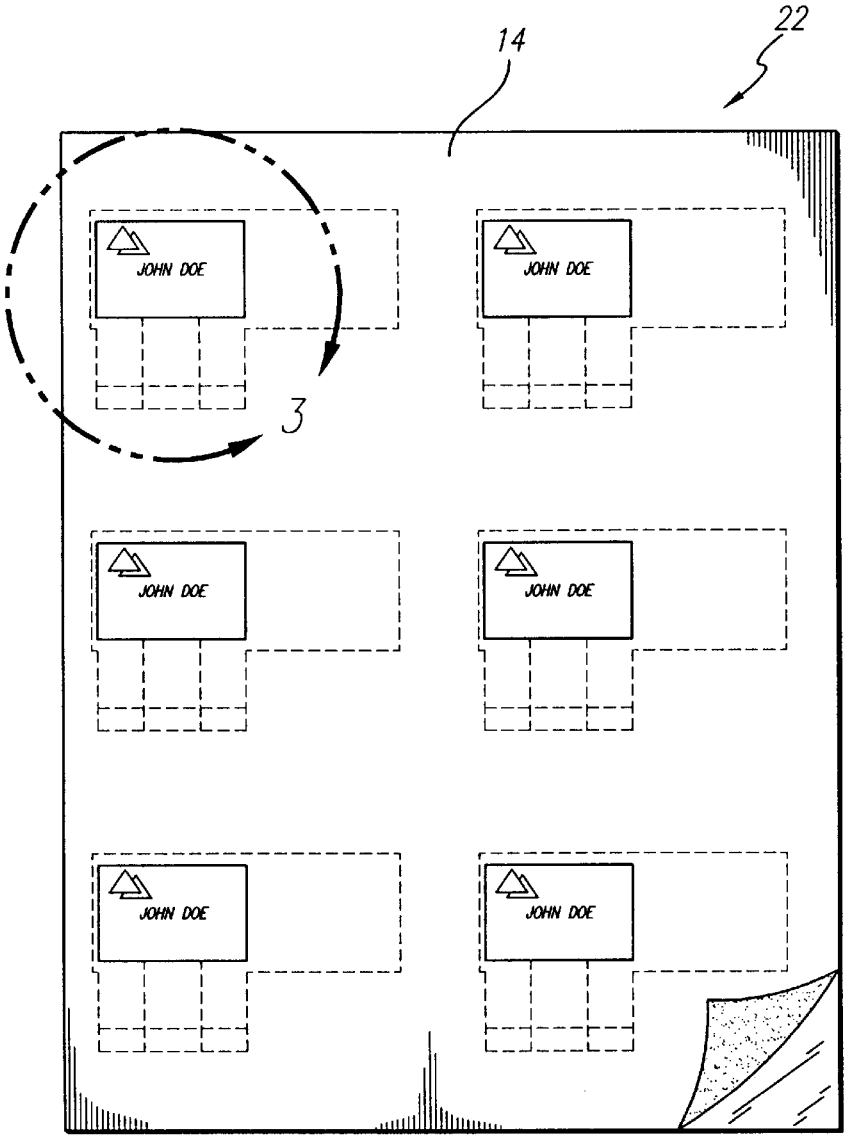
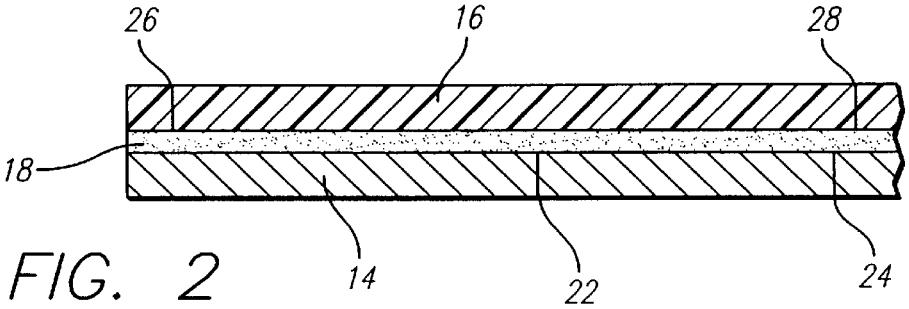
FIG. 2

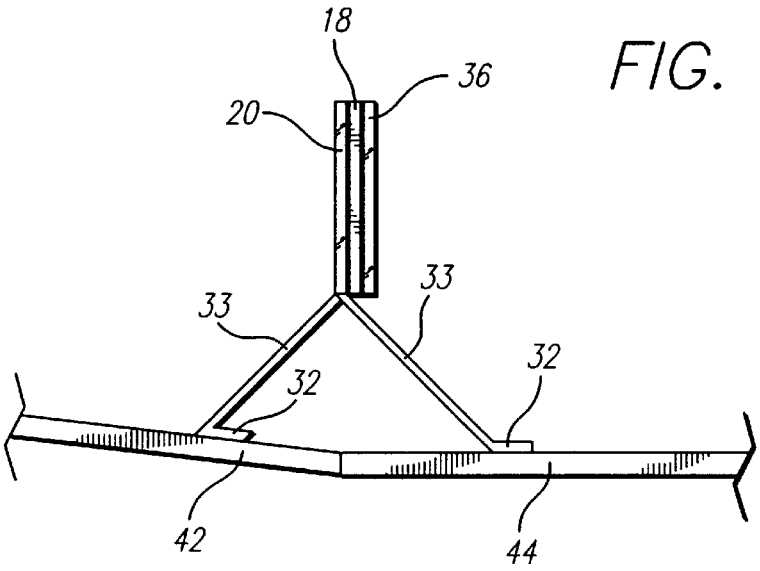
FIG. 5
FIG. 6
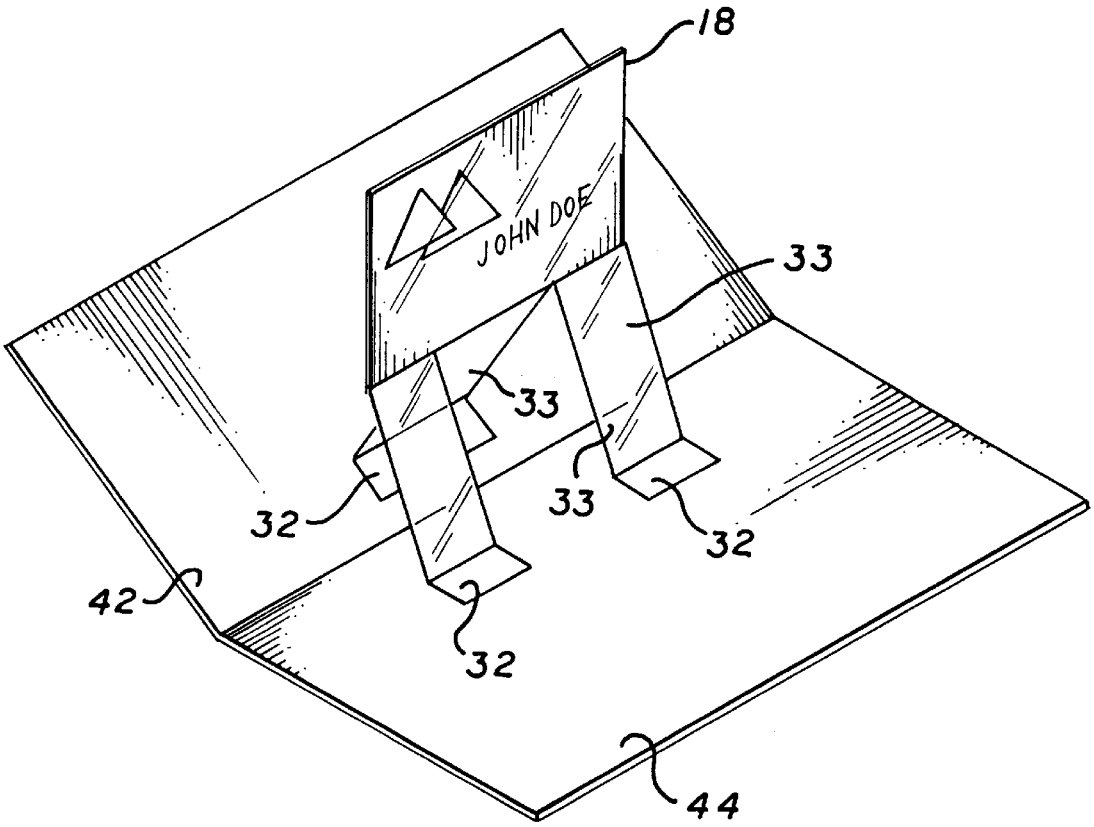

FLOATING POP-UP DISPLAY STRUCTURES

FIELD OF THE INVENTION

This invention relates to so-called "pop-up" structures or stickers wherein, when a folded sheet is unfolded, an attention-grabbing paper structure pops up out of the unfolded sheet.

BACKGROUND OF THE INVENTION

Pop-up structures are well known, and typical known pop-up structures are shown in the following listed patent documents: U.S. Pat. No. 5,346,455 granted Sep. 13, 1994; 4,146,983 granted Apr. 13, 1979; 5,181,901 granted Jan. 26, 1993; and published application PCT/US96/04360. Typical pop-up structures are shown in U.S. Pat. No. 5,582,888 in FIGS. 29, 34, 45, and 72. These structures are intended to be used with a pair of hinged panels, and have integral supporting structures or "legs" extending from the main display area of the pop-up structures, with these supporting structures or legs being secured to both of the two hinged panels, so that when the hinged panels are unfolded, the main display area "pops up" from the panels.

SUMMARY OF THE INVENTION

In accordance with the present invention, it has been determined that it would be desirable to provide pop-up structures or stickers having the effect that the main display area of the structure appears to be "floating" or suspended above the hinged panels, when the panels are opened.

In accordance with one aspect of the invention, this may be accomplished by providing transparent supports, in some cases "legs," for the main display area of a pop-up structure or sticker.

In one illustrative embodiment of the invention, a two-layer laminate of cardstock or paper and transparent plastic sheet material, with pressure-sensitive adhesive between the two layers, may be employed. This laminated sheet material may be of the type disclosed, for example, in U.S. Pat. No. 5,662,976, granted Sep. 2, 1997, the specification of which is hereby incorporated into this specification.

The main display area for the pop-up sticker structure may be die cut from the cardstock layer; and the transparent plastic layer may be die cut to have one area secured to the display area of the cardstock, and additional die cuts from the transparent layer providing a supporting structure or legs, to be secured to the hinged panels. The next step would be printing onto the display area of the cardstock. Then, the cardstock die cut display area may be pushed through the laminated sheet assembly, taking with it the die cut transparent plastic sheet material secured to the display area, and the transparent supporting structure or legs; and finally the lower ends of the legs are secured by adhesive to the two hinged panels to provide the desired pop-up action.

Additional features of the invention may include:

1. The die cutting of an additional area of the transparent plastic to fold over and protect the printed or decorated display area of the cardstock.
2. Adhesive limited to the lower ends or feet of the transparent supporting legs, with the back of the upper portions of the legs not having active adhesive. This can be accomplished by (a) not coating these areas with adhesive, (b) deadening the adhesive on these areas, (c) putting the adhesive only on areas of the hinged panels to which the supporting structure or legs are to be secured, or (d) die cutting and folding areas of the transparent plastic over adhesive coated upper leg portions.

3. The display area may be die cut to include a symbol or any desired irregular shape.
4. The feet of the supporting legs may face either in the same direction (preferred when the transparent plastic sheet material is coated with adhesive), or may both face the hinge line of the hinged panels (preferred for neatness when adhesive is applied to the panels).
5. When other pop-up structures such as those shown in the cited patents are employed (see FIGS. 8 and 10 of U.S. Pat. No. 4,146,983, for example), portions of the pop-up structures secured to the hinged panels may be of the transparent plastic sheet material along with immediately adjacent structural parts, and with some or all of the remaining display portions of the cardstock or paper being laminated transparent plastic and cardstock or paper.

In accordance with a broad aspect of the invention, therefore, a pop-up structure for use with two hinged panels may include a display area of one material to which decoration or printing may be applied, and supports formed of transparent plastic sheet material are adhered to said display area and extending away from said display area to both of said hinged panels, so that when said panels are closed, the pop-up structure folds flat. Further, when the panels are hinged open, the display area pops up, and appears to "float" from the hinged panels, supported by the transparent supports.

Other objects, features, and advantages of the invention will become apparent from a consideration of the following detailed description and from the accompanying drawings.

BRIEF DESCRIPTION OF THE DRAWINGS

FIG. 1 shows a plan view of a sheet assembly for forming a pop-up sticker illustrating the principles of the present invention;

FIG. 2 is a partial cross-sectional view taken along line 2—2 of FIG. 4;

FIG. 5 is a side view of a pop-up sticker mounted on two hinged panels;

FIG. 6 is a perspective view of the pop-up sticker of FIG. 5;

DETAILED DESCRIPTION OF PREFERRED EMBODIMENT

Referring more particularly to the drawings, FIG. 1 shows a laminated sheet assembly 12, including a top layer 14 of printable material such as cardstock, a bottom layer 16 of transparent plastic sheet material, and an intermediate layer 18 of pressure sensitive adhesive, which may be either of the temporary or removable type or of the permanent pressure sensitive adhesive type.

Figure 3:
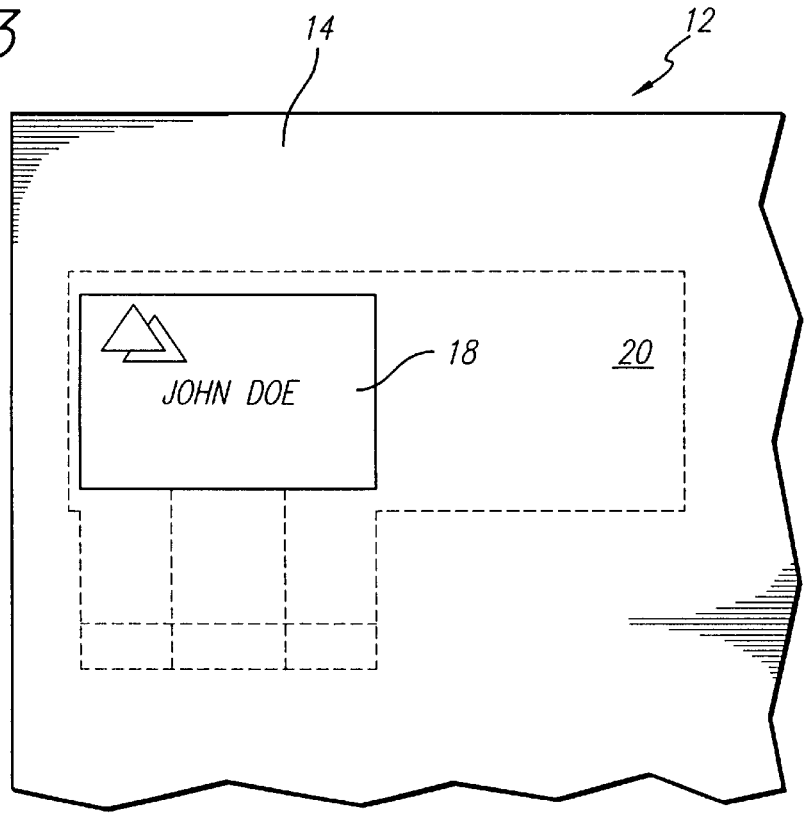
FIG. 3 is an enlarged top view of one corner of the assembly of FIG. 1 showing die cuts in the two layers of the assembly.
Figure 4:
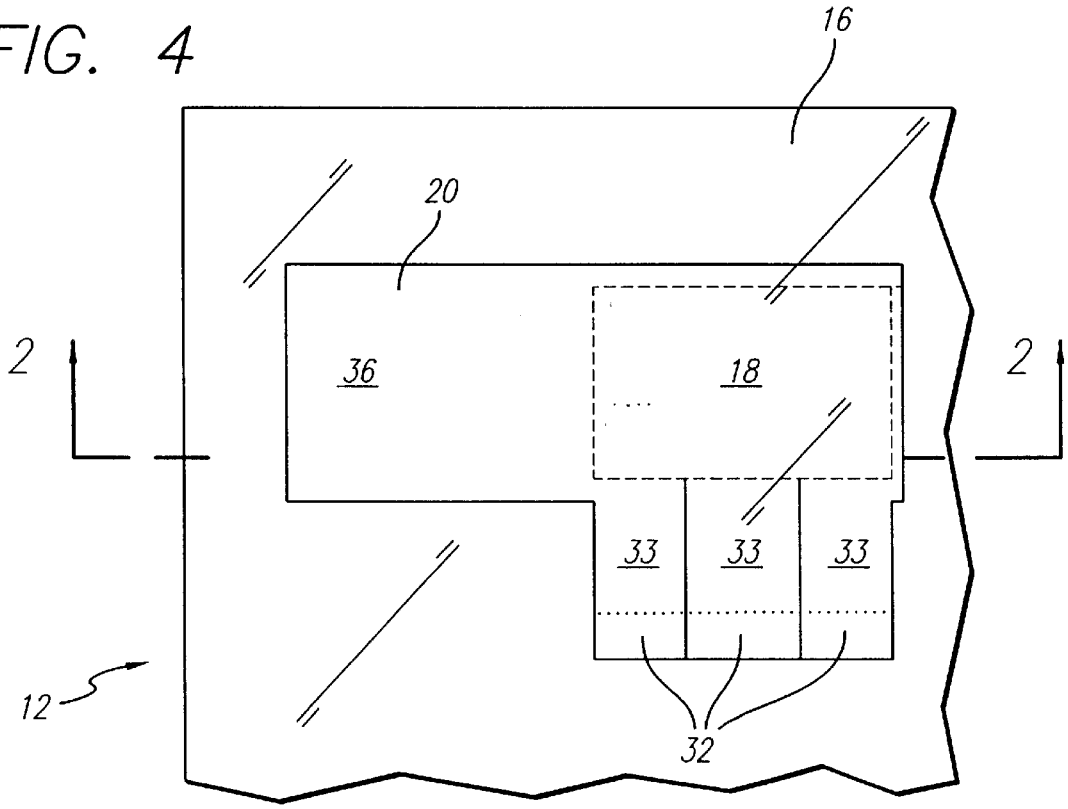
FIG. 4 is an enlarged view of the other side of the same corner of the assembly.

FIG. 3 shows one corner of the sheet 12 from the side of the laminated assembly on which the cardstock 14 is present; and FIG. 4 shows the same comer taken from the side 16 of the laminated assembly which is a transparent plastic layer. In FIG. 3, the area 18 is a display area and is shown outlined in solid lines. These solid lines in FIG. 3 represent die cuts through the plastic, or cuts which may be made in other manners, as by a laser beam, for a specific example. FIG. 3, the dashed line outline 20 represents the die cutting of the transparent plastic sheet material 16, which is the lower layer of the laminated assembly.

In FIG. 4, the area 20 is shown in solid lines representing the die cutting of the transparent plastic sheeting material, and the display area 18 of the cardstock or other printable sheet material is shown in dashed lines.

FIG. 2 is a schematic cross-sectional view taken along lines 2—2 of FIG. 4. The display area 18 is shown with the cuts 22 and 24, which extend through the cardstock layer 14. The transparent sheet material 16 is shown with die cuts 26 and 28 extending through the layer 16.

Concerning the thickness of the assembly 12, the showing of FIG. 2 greatly exaggerates the thickness of the cardstock and the transparent layer. It is intended that the sheet 12 be printed on the display area with a design or with printing in a laser printer, an ink jet printer, or a typical office computer printer or copier. It is therefore desirable that the sheet assembly 12 be relatively thin, preferably in the order of 10 or 15 mils thick, so that it will easily be printed in an office printer or copier without jamming. However, it is contemplated that the assembly may well have a thickness from about 5 to 20 mils, as a broader range, depending on the printer or copier with which the assembly is to be used, and other factors.

Concerning the adhesive layer 18, as shown in FIG. 2, it may either be a continuous layer covering the entire area between the sheets 14 and 16, or it may be applied only to certain areas. More specifically, as shown in FIG. 4, it is desirable that adhesive be present on the broad upper rectangular area 20, which is intended for engagement with the display area 18, and on the lower areas or feet 32, of the depending legs 33 which extend downwardly from the display area 18. However, it is preferred that, for subsequent steps of a method in accordance with the invention to be described below, that the upper areas of the legs 33 be non-tacky. This can be accomplished either by not applying adhesive to the areas between the two sheets corresponding to the upper portions of these legs 33, or by other steps as will be discussed hereinbelow.

Following cutting either by die cutting or other steps, of the display area 18 and the transparent sheet 20, the display portion 18 of the cardstock layer 14, is pushed through the assembly 10, carrying with it the mounting area 20 along with the associated legs 33. The right-hand flap 36 of the plastic material 20 is then folded over the display 18 to seal it and protect against defacement.

The next step is to secure the pop-up sticker to a pair of hinged panels 42 and 44 as shown in FIGS. 5 and 6, for example. This is accomplished by securing the two feet 32 of the outer two legs 33 to one of the two panels 44, while the central leg 33 is secured to the other panel 42, in each case with the pressure-sensitive adhesive on the feet 32 holding the legs in the desired position on the panels 42 and 44.

The points where the feet are to be secured to the panels is determined so that, when the panels are hinged to their closed configuration, the pop-up structure lies flat. In order to accomplish this, if the legs are equal length, the pivot point between the legs and the feet associated with each leg must be equidistant from the central hinge line. Of course, if the legs are slightly different in length, a slightly different positioning of the feet on the two panels will be appropriate in order for the pop-up sticker to lie flat, when the panels are folded together.

FIG. 6 shows to advantage the floating aspect of the pop-up sticker which is achieved when the transparent legs 33 are employed to support the opaque display member 18.

Figure 7:
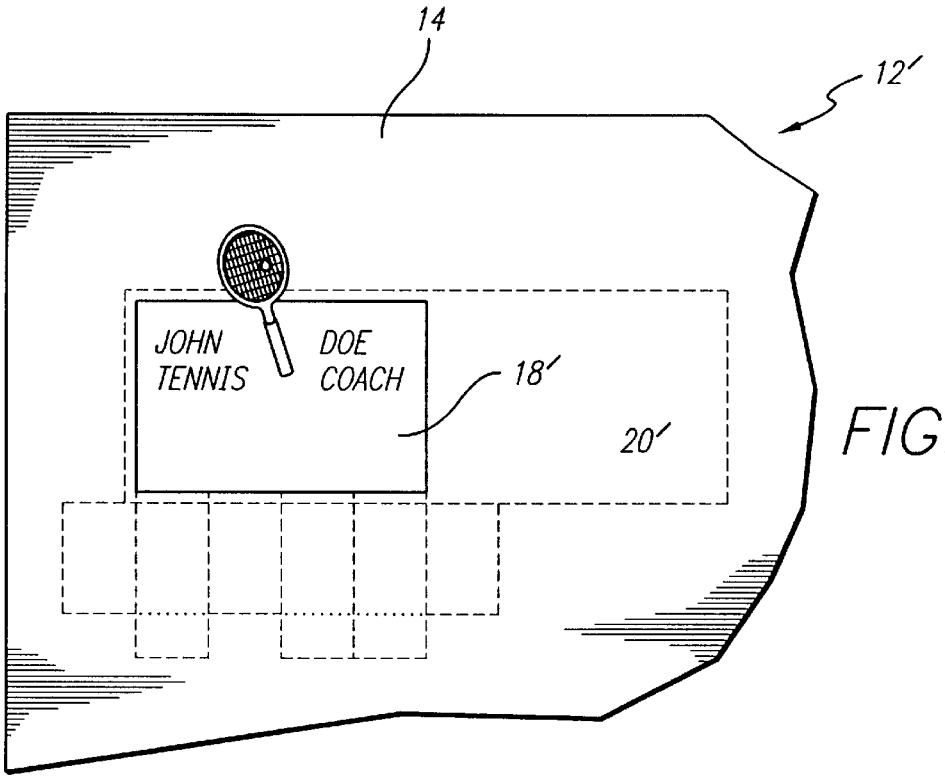
FIG. 7 is an alternative embodiment illustrating the invention, and showing the cardstock side of a laminated sheet assembly.
Figure 8:
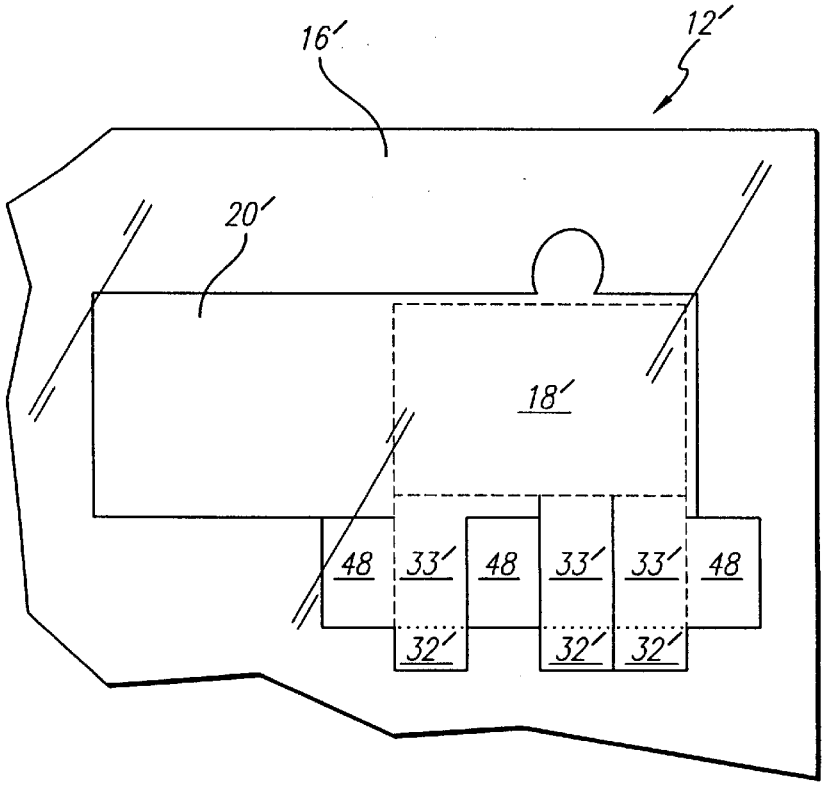
FIG. 8 shows the assembly of FIG. 7 from the transparent plastic side of the assembly.

FIGS. 7 and 8 show an alternative pop-up sticker configuration, and in these figures reference numerals will be employed which are similar to the reference numerals employed in the earlier figures of the drawings, but with primes added to the corresponding reference numerals. With regard to FIGS. 7 and 8, the principal difference as compared with the other embodiment of the invention lies in the use of a continuous layer of adhesive between the upper cardstock sheet 14', and the lower transparent plastic sheet 16'. When a continuous layer of adhesive is employed, it is desirable to provide arrangements for making the upper portions of the legs 33' non-tacky. As shown in FIG. 8, this is accomplished through the use of the supplemental tab 48, which may be folded over the upper portions of the legs 33' and thus make the resultant supporting legs somewhat stiffer as well as being non-tacky. The feet 32', still bear a pressure-sensitive adhesive layer, and these feet are employed to mount the pop-up sticker on the panels such as the panels 42 and 44, as shown in FIG. 6 of the drawings.

It is to be understood that the foregoing detailed description relates to preferred illustrative embodiments of the invention. Various changes and modifications may be made by those skilled in the art without departing from the spirit and scope of the invention. Thus, by way of example and not of limitation, the upper display layer, instead of being formed of cardstock, may be formed of heavy paper, of opaque plastic or any other suitable display material. Floating pop-up stickers may also be formed by providing transparent supports for pop-up stickers which have been proposed heretofore. Thus for example the end portions of the pop-up structure shown in FIG. 8 of U.S. Pat. No. 4,146,983 may be formed of transparent material; and similarly, the supporting structures for the displays shown in FIGS. 29, 45 and 47 of U.S. Pat. No. 5,181,901 may be made of transparent materials. It is also noted that the adhesive may be applied to the panels 42, 44 instead of to the feet 33 of the pop-up structures. Accordingly, the present invention is not limited precisely to the specific embodiments shown and described in detail hereinabove.

What is claimed is:

1. A "floating" pop-up sticker for mounting on a folded assembly having a fold line, comprising:

a first sheet of heavy paper or cardstock;

a second sheet of transparent flexible plastic material generally coextensive with and overlying said first sheet;

adhesive material between said first and second sheets;

said first sheet being die cut to form a pop-up, opaque display to be spaced from said folded assembly when said folder is opened; and said second transparent sheet being die cut to overlap and engage said opaque display, and to have at least two supports extending from said opaque display, said supports having transparent spacing portions adjacent said display, and transparent securing portions provided with pressure-sensitive adhesive for mounting said securing portions on opposite sides of said fold line so that when said folder is closed the pop-up sticker lies flat without wrinkles, and when the folder is opened the opaque display rises from the surfaces of said open folded assembly, and is held in an elevated position by said transparent spacing portions;

whereby said opaque display appears to float above the surface of said folded assembly.

2. A "floating" pop-up sticker for mounting on a folded assembly having a fold line, as defined in claim 1 wherein said spacing portions have no exposed adhesive.

3. A "floating" pop-up sticker for mounting on a folded assembly having a fold line, as defined in claim 1 wherein three supports are provided in the form of extended legs, with two of said legs being for securing on one side of the fold line, and the third leg being for securing to the other side of said fold line.

4. A "floating" pop-up sticker for mounting on a folded assembly having a fold line, as defined in claim 1 wherein the opaque display has indicia thereon, and wherein said transparent plastic is die cut to provide a flap which may be folded over said indicia to seal the opaque display between two layers of plastic.

5. A "floating" pop-up structure for use with hinged first and second panels, comprising:

a display area formed of a first predetermined sheet material bearing a visible display;

flexible transparent sheet material bonded to said display area and having first and second supporting portions for securing respectively to the first and second panels;

adhesive for securing said support portions to said panels; and said structure with its sheet material being configured to lie flat between said first and second panels when they are closed together;

whereby said display area is mounted by said transparent supporting portions and appears to pop up and float over said hinged panels when they are opened.

6. A "floating" pop-up sticker for mounting on a folded assembly having a fold line, as defined in claim 5 wherein said support structure is formed of three legs of said transparent sheet material with two of said legs being adapted for securing to a first one of said panels, and the other of said legs being adapted for securing to the second one of said panels.

7. A "floating" pop-up sticker for mounting on a folded assembly having a fold line, as defined in claim 6 wherein the lower ends of said legs are provided with adhesive for securing to said panels, and wherein the upper portions of said legs are not tacky.

8. A "floating" pop-up sticker for mounting on a folded assembly having a fold line, as defined in claim 5 wherein said transparent plastic sheet material extends over both the front and the back of said display area.

9. A three-layer sheet assembly for forming a pop-up sticker for use with first and second hinged panels, said assembly comprising:

a first layer of thin printable sheet material;

a second layer of flexible transparent plastic sheet material;

a layer of adhesive between said first and second layers of sheet material;

said first layer being cut into a display area;

said second layer being cut into a mounting configuration which overlaps and which is adhesively secured to said display area, and which includes first and second support areas extending away from said display area; and said first and second support areas being provided with adhesive for mounting to said first and second panels, respectively;

whereby said display area may be pushed through said transparent sheet material, carrying the transparent mounting configuration with the display area, and the first and second support areas may be adhesively secured to said first and second panels, respectively, so that said display area appears to pop up and float above said hinged panels when they are opened.

10. An assembly as defined in claim 9 wherein said support areas include legs having their ends away from said display area coated with pressure-sensitive adhesive for securing to said panels.

11. An assembly as defined in claim 9 wherein said transparent second layer is die cut into an additional area which may be folded to overly said display area, thereby providing a protective layer over said display area.

12. An assembly as defined in claim 9 wherein said display area bears indicia from an ink jet or laser printer.

13. An assembly as defined in claim 9 wherein said assembly is between 5 and 20 mils thick so that it may be printed in a desktop-type printer.

14. An assembly as defined in claim 9 wherein said assembly is between 8 and 15 mils. thick.

15. An assembly as defined in claim 9 wherein selected areas of said mounting configuration which do not overlap said display area are non-tacky.

16. An assembly as defined in claim 15 wherein said selected areas are free of adhesive.

17. An assembly as defined in claim 9 wherein said first layer is provided with a release coating in certain areas which are outside of said display area, to permit ready release of said mounting configuration of said transparent layer from said first printable layer of sheet material.

18. A method of forming a printed floating pop-up sticker comprising the steps of:

forming the assembly of claim 9;

printing said assembly in a desktop-type printer and specifically applying indicia to the display areas of said assembly;

removing the display area and associated mounting configuration adhesively secured together from said assembly;

mounting said first and second support areas onto said first and second panels, respectively, so that said display area and the mounting configuration lie flat when said panels are closed; and opening said panels so that said display area pops up and appears to float over the panels, as it is supported by the mounting configuration formed of the transparent sheet material.

19. A method as defined in claim 18 wherein the mounting step includes a mounting configuration having three legs, and involves securing two of the legs to said first panel and one of said legs to said second panel.

20. A method as defined in claims 18 further including the step of providing pressure-sensitive adhesive on the extreme ends of said legs away from said display area and making the upper portions of said legs non-tacky.

21. A method as defined in claim 20 wherein said pressure-sensitive adhesive is provided as permanent pressure-sensitive adhesive.

22. A method as defined in claim 20 wherein said legs are of substantial equal length, and are divided by a fold line into an upper portion and a foot bearing adhesive, and wherein said mounting step includes adhering said feet to said panels with said fold lines located equal distances from the hinge line of said two hinged panels.

23. A method as defined in claim 18, wherein said transparent mounting configuration is cut to provide an additional flap having an extent approximately equal to that of said display area, and folding this flap across the display area to protect the display area.

24. A method as defined in claim 18 wherein the step of forming the assembly includes the step of coating the layer of printable sheet material with a release coating in certain areas away from said display area.

* * * * *